US011040268B2

(12) United States Patent
Brown

(10) Patent No.: US 11,040,268 B2
(45) Date of Patent: Jun. 22, 2021

(54) PORTABLE SKI AND SKI POLE CARRYING DEVICE

(71) Applicant: Scott Thomas Brown, Minneapolis, MN (US)

(72) Inventor: Scott Thomas Brown, Minneapolis, MN (US)

( * ) Notice: Subject to any disclaimer, the term of this patent is extended or adjusted under 35 U.S.C. 154(b) by 0 days.

(21) Appl. No.: 16/863,853

(22) Filed: Apr. 30, 2020

(65) Prior Publication Data

US 2020/0346098 A1 Nov. 5, 2020

Related U.S. Application Data

(60) Provisional application No. 62/843,196, filed on May 3, 2019.

(51) Int. Cl.
*A63C 11/02* (2006.01)

(52) U.S. Cl.
CPC ..... *A63C 11/025* (2013.01); *A63C 11/021* (2013.01)

(58) Field of Classification Search
CPC .... A63C 11/021; A63C 11/022; A63C 11/025
USPC ..... 280/814, 815
See application file for complete search history.

(56) References Cited

U.S. PATENT DOCUMENTS 2,562,178 A * 7/1951 Djos ..... A63C 11/021 280/814
3,279,008 A * 10/1966 Wallach ..... A63C 11/021 24/16 PB
3,366,297 A * 1/1968 Barsell ..... A63C 11/021 294/166
3,479,044 A * 11/1969 Peis ..... A63C 11/022 280/601
3,620,543 A * 11/1971 Peis ..... A63C 11/022 280/601
3,731,348 A * 5/1973 Luehne ..... A44B 18/00 280/814
3,936,067 A * 2/1976 Link ..... A63C 11/021 280/814
3,947,927 A * 4/1976 Rosenthal ..... A63C 11/025 24/306
3,994,048 A * 11/1976 Rosenthal ..... A63C 11/025 24/306
4,015,762 A * 4/1977 Mendillo ..... A63C 11/025 294/149
4,055,287 A * 10/1977 Champenois, Jr. .. A63C 11/027 294/141
4,114,838 A * 9/1978 Knauf ..... A45F 5/00 224/917

(Continued)

*Primary Examiner* — Jeffrey J Restifo

(57) ABSTRACT

The disclosure includes a ski and ski pole carrying device that in many embodiments comprises two ski ties and lanyard. A ski pole strap with the proximal end coupled to a ski sleeve forms the ski tie. The ski ties may leave enough space between the sheaths and the bases to allow a portion of the skis' tips and tails to be slideably received by the ski tie as to secure the skis together. The ski ties may be arranged and configured for the skis' bases to be facing the same direction or in opposite directions. In some embodiments, the ski pole straps are a double sided hook and loop fastener arranged and configured to securely wrap around the respective ski tie and a pair of ski poles. The lanyard may be used in conjunction with the ski ties or independently to aid in carrying the skis and ski poles.

19 Claims, 11 Drawing Sheets

(56) References Cited

U.S. PATENT DOCUMENTS 4,120,437 A * 10/1978 Hara ..... A63C 11/025 24/306
4,269,435 A * 5/1981 Jarvenkyla ..... A63C 11/025 280/814
4,274,571 A * 6/1981 Lafreniere ..... A63C 11/025 211/70.5
4,377,306 A * 3/1983 Abatecola ..... A63C 11/025 280/814
4,465,304 A * 8/1984 Hicks ..... A63C 11/027 280/814
4,470,528 A * 9/1984 Dyess ..... A63C 11/025 224/257
4,531,661 A * 7/1985 Santy ..... A63C 11/025 224/191
4,540,198 A * 9/1985 Kyburz ..... A63C 11/026 188/1.12
4,553,779 A * 11/1985 Shortridge ..... A63C 11/025 224/917
4,673,118 A * 6/1987 Kronz ..... A63C 11/025 224/259
4,817,837 A * 4/1989 Grover ..... A63C 11/021 224/250
4,852,931 A * 8/1989 Ferdi ..... A63C 11/025 294/147
4,856,689 A * 8/1989 Shore ..... A63C 11/025 224/218
5,012,921 A * 5/1991 Becker ..... A63C 11/023 206/315.1
5,022,678 A * 6/1991 Mayfield ..... A63C 11/00 150/154
5,056,819 A * 10/1991 Hayes ..... A63C 11/22 280/809
5,056,820 A * 10/1991 Des Prez ..... A63C 11/025 280/814
5,066,044 A * 11/1991 Adasek ..... A63C 11/027 280/815
5,094,479 A * 3/1992 Shields ..... A63C 11/025 224/917
5,104,017 A * 4/1992 Vandagriff ..... A63C 11/025 224/250
5,197,760 A * 3/1993 Schollenberger ..... A63C 11/02 224/917
5,282,535 A * 2/1994 Rowland ..... A63C 11/023 206/315.1
5,335,835 A * 8/1994 Hogan ..... A45F 3/14 224/257
5,350,096 A * 9/1994 Sieber ..... A45F 3/14 224/153
5,356,180 A * 10/1994 Adasek ..... A63C 11/027 280/814
5,427,291 A * 6/1995 Smith ..... A63C 11/025 224/250
5,450,991 A * 9/1995 Neading ..... A45F 3/00 224/578
5,464,138 A * 11/1995 Rodriguez ..... A63C 11/025 224/265
5,468,036 A * 11/1995 Brown ..... A63C 11/021 294/147
5,611,588 A * 3/1997 Mencel ..... A63C 11/02 280/814
6,273,272 B1 * 8/2001 Hake ..... A63C 11/028 211/4
7,374,207 B2 * 5/2008 McCoy ..... A63C 5/062 280/809
8,371,614 B2 * 2/2013 Rodriguez ..... A63C 11/025 280/814
8,491,011 B2 * 7/2013 Valaas ..... A63C 11/021 280/814
8,616,600 B2 * 12/2013 Owen ..... A63C 11/025 294/154
8,746,769 B2 * 6/2014 Owen ..... A63C 11/025 294/154
10,427,025 B2 * 10/2019 Greenfield ..... A45F 3/14
10,464,727 B1 * 11/2019 Rerecich ..... A45F 5/10
10,493,355 B2 * 12/2019 Reid ..... A45F 5/021
10,695,652 B1 * 6/2020 Shute ..... B63B 32/80

* cited by examiner

PORTABLE SKI AND SKI POLE CARRYING DEVICE

TECHNICAL FIELD

The present invention relates generally to portable ski and ski pole carrying devices. More particularly, the present invention relates to ski and ski pole lanyard and sleeve devices which aid in handling and carrying of ski equipment.

BACKGROUND

Due to their elongated shape, skis and ski poles are awkward to carry safely and effectively. The sharp tips of ski poles are dangerous if not controlled in large groups of people like after races and congested ski areas. Many prior art ski and ski pole carrying devices have been proposed. Generally, these devices combine the skis and poles in a single unit with the skis and ski poles generally parallel to one another for easy carrying.

A drawback to current carrying systems is that they are not easy to stow when skiing and carry when ambulating or they only carry skis or poles, not both. Typically a skier needs to walk to and from transportation with skis and ski poles over uneven, snowy and icy terrain. Having minimal equipment to store while skiing but the convenience of a system to safely and easily carry skis and ski poles before and after skiing is very beneficial for the skier and safer for those in the vicinity of the skier especially after a race.

SUMMARY

The present disclosure includes a ski and ski pole carrying device that in some embodiments comprises two ski ties and lanyard. The device may comprise a first ski tie configured to receive a first ski and a second ski including a first base, a first sheath configured to surround at least a portion of the first ski and a second sheath configured to surround at least a portion of the second ski coupled to the first base, and a first ski pole strap with the proximal end coupled to at least one of the first base, the first sheath, and the second sheath. The device may also comprise a second ski tie configured to receive a first ski and a second ski including a second base, a third sheath configured to surround at least a portion of the first ski and a fourth sheath configured to surround at least a portion of the second ski coupled to the second base, and a second ski pole strap with the proximal end coupled to at least one of the second base, the third sheath, and the fourth sheath.

In some embodiments, the second surface of the first base faces opposite the first surface of the first base and the second surface of the second base faces opposite the first surface of the second base. The first base may be arranged and configured to receive the first ski along the first surface and receive the second ski along the second surface such that the first ski and the second ski face opposite each other. The second base may be arranged and configured to receive the first ski along the first surface and receive the second ski along the second surface such that the first ski and the second ski face opposite each other.

In some embodiments, the first sheath and the second sheath may be separate sheaths and the third sheath and the fourth sheath may be separate sheaths. In some embodiments, the first sheath and the second sheath may be one continuous first ski tie sheath and the third sheath and the fourth sheath may be one continuous second ski tie sheath. In some embodiments, the ski ties leave enough space between the sheaths and the bases to allow a portion of the skis' tips and tails to be slideably received by the ski tie as to secure the skis together.

In some embodiments, the first ski pole strap is double sided hook and loop fastener arranged and configured to wrap around the first base, the first sheath, and the second sheath whereby a first surface of the first ski pole strap detachably couples to a second surface of the first ski pole strap. In some embodiments, the second ski pole strap is double sided hook and loop fastener arranged and configured to wrap around the second base, the third sheath, and the fourth sheath whereby a first surface of the second ski pole strap detachably couples to a second surface of the second ski pole strap. The first and second ski pole straps are further arranged and configured to wrap around a pair of ski poles. The distal end of the first and second ski pole straps are arranged and configured to allow for a user to easily grip the distal end during cold weather with gloves on to manipulate the ski pole strap into the proper configuration for use.

In some embodiments, the ski and ski pole carrying device is arranged and configured wherein a space between the first base and the first sheath is arranged and configured to slideably receive at least a portion of the first ski while a space between the first base and the second sheath is arranged and configured to slideably receive at least a portion of the second ski. A space between the second base and the third sheath is arranged and configured to slideably receive at least a portion of the first ski while a space between the second base and the fourth sheath is arranged and configured to slideably receive at least a portion of the second ski In some embodiments, the present disclosure includes a ski and ski pole carrying device further comprising an adjustable closed loop lanyard used to aid in the carrying of the bundle of skis and ski poles. The adjustable closed loop lanyard may comprise a fisherman's knot with a symmetrical structure comprising overhand knots, in their strangle knot form, in each end of the cord around the standing part of the opposite cord. The lanyard circumference may be adjusted by sliding the knots until the desired configuration is attained.

In some embodiments, the ski and ski pole carrying device may comprise a first base with a first surface and a second surface facing opposite the first surface wherein the first base is arranged and configured to receive the first ski along the first surface and the second ski along the first surface such that a base of the first ski faces faces the same direction as the base of the second ski. The ski and ski pole carrying device may further comprise a second base with a first surface and a second surface facing opposite the first surface wherein the second base is arranged and configured to receive the first ski along the first surface and the second ski along the first surface such that a base of the first ski faces faces the same direction as the base of the second ski.

In some embodiments, the first base of the ski and ski pole carrying device may comprise a second surface that defines a first half and a second half located opposite the first half, wherein the first base is configured to fold along a middle portion such that the first half of the second surface contacts at least a portion of the second half of the second surface. The second base of the ski and ski pole carrying device may further comprise a second surface that defines a first half and a second half located opposite the first half, wherein the second base is configured to fold along a middle portion such that the first half of the second surface contacts at least a portion of the second half of the second surface.

In some embodiments, the ski and ski pole carrying device may be arranged and configured in a first state and a second state. In the first state, the first base receives the first ski and the second ski and the base of the first ski and the base of the second ski both face the same direction with the skis in a side-by-side position. In the second state the first base receives the first ski and the second ski and the base of the first ski and the base of the second ski face opposite directions with the skis in a base-to-base position.

In some embodiments of the ski and ski pole carrying device, the first sheath and the second sheath are coupled to a first surface of the first base and the third sheath and the fourth sheath are coupled to a first surface of the second base.

In some embodiments of the ski and ski pole carrying device, the first sheath is coupled to a first surface of the first base and the second sheath is coupled to a second surface of the first base where the second surface is facing opposite the first surface. In some embodiments of the ski and ski pole carrying device, the third sheath is coupled to a first surface of the second base and the fourth sheath is coupled to a second surface of the second base where the second surface is facing opposite the first surface.

In some embodiments of the ski and ski pole carrying device, the first sheath and the second sheath may be coupled to a first surface of the first base along a first portion and a second portion located opposite the first portion with a middle portion located between the first portion and the second portion. The third sheath and the fourth sheath may be coupled to a first surface of the second base along a first portion and a second portion located opposite the first portion with a middle portion located between the first portion and the second portion.

BRIEF DESCRIPTION OF THE DRAWINGS

These and other features, aspects, and advantages are described below with reference to the drawings, which are intended to illustrate, but not to limit, the invention. In the drawings, like reference characters denote corresponding features consistently throughout similar embodiments.

DETAILED DESCRIPTION

Although certain embodiments and examples are disclosed below, inventive subject matter extends beyond the specifically disclosed embodiments to other alternative embodiments and/or uses, and to modifications and equivalents thereof. Thus, the scope of the claims appended hereto is not limited by any of the particular embodiments described below. For example, in any method or process disclosed herein, the acts or operations of the method or process may be performed in any suitable sequence and are not necessarily limited to any particular disclosed sequence. Various operations may be described as multiple discrete operations in turn, in a manner that may be helpful in understanding certain embodiments; however, the order of description should not be construed to imply that these operations are order dependent. Additionally, the structures, systems, and/or devices described herein may be embodied as integrated components or as separate components.

For purposes of comparing various embodiments, certain aspects and advantages of these embodiments are described. Not necessarily all such aspects or advantages are achieved by any particular embodiment. Thus, for example, various embodiments may be carried out in a manner that achieves or optimizes one advantage or group of advantages as taught herein without necessarily achieving other aspects or advantages as may also be taught or suggested herein.

Figure 1:
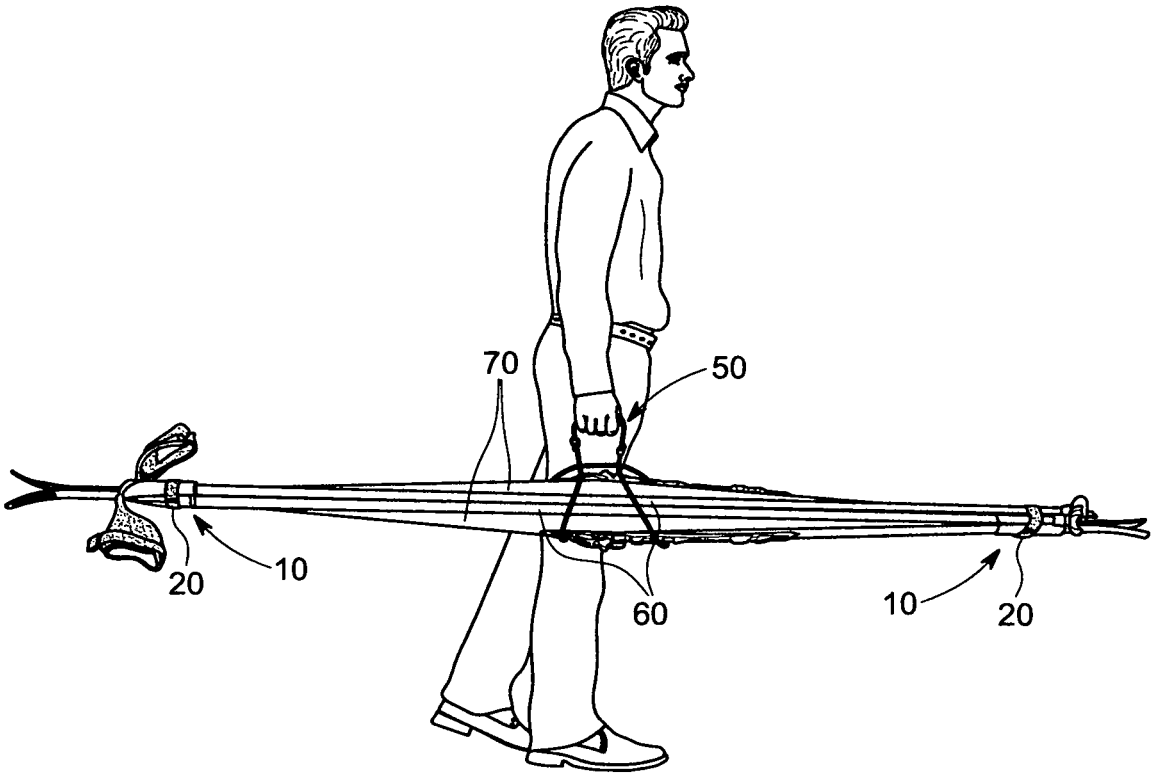
FIG. 1 illustrates an isometric view of the skis and ski poles bundled with the ski ties and being carried by the lanyard. The skis are in a base-to-base position.

The light weight and easy stowability of the portable ski and ski pole carrying device as illustrated in FIG. 1 make it perfect for nordic skiing since the skiers dress light and carry minimal gear. The skier would be unencumbered by stowing the device in a pocket or waist pack while skiing. Nordic ski poles 60 are longer and harder to control while carrying than downhill ski poles and nordic ski poles 60 also have sharper and more dangerous tips 62. Keeping nordic ski poles 60 bundled with skis 70 so the ski pole tips 62 are protected and under better control is important to the safety of those around the skier. In contrast, downhill skiers dress heavier so carrying ski and ski pole carrying devices that are heavier and bulkier is less impactful. Since downhill ski poles are shorter and easier to carry and the downhill ski pole tips aren't as sharp there is not as great of a safety concern as there is with nordic ski poles 60.

Figure 2:
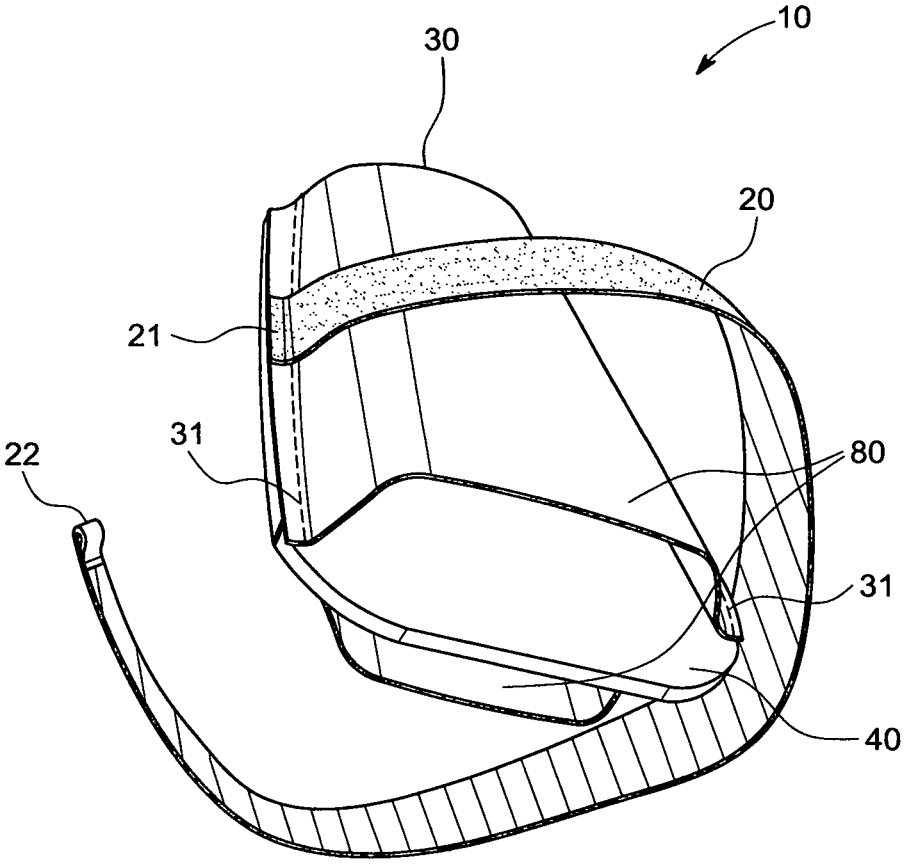
FIG. 2 illustrates an isometric view of a ski tie arranged and configured with the first sheath coupled to a first surface and a second sheath coupled to a second surface facing opposite the first surface with the ski pole strap undone.
Figure 3:
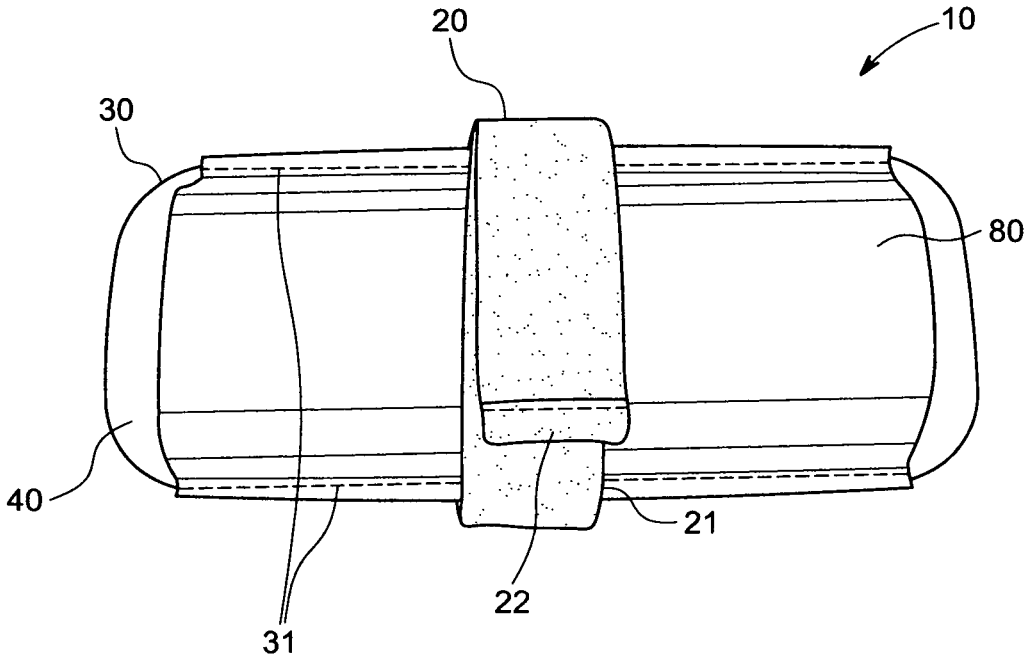
FIG. 3 illustrates a top view of a ski tie arranged and configured with the sheaths coupled to opposite surfaces of the base with the ski pole strap secured.
Figure 9:
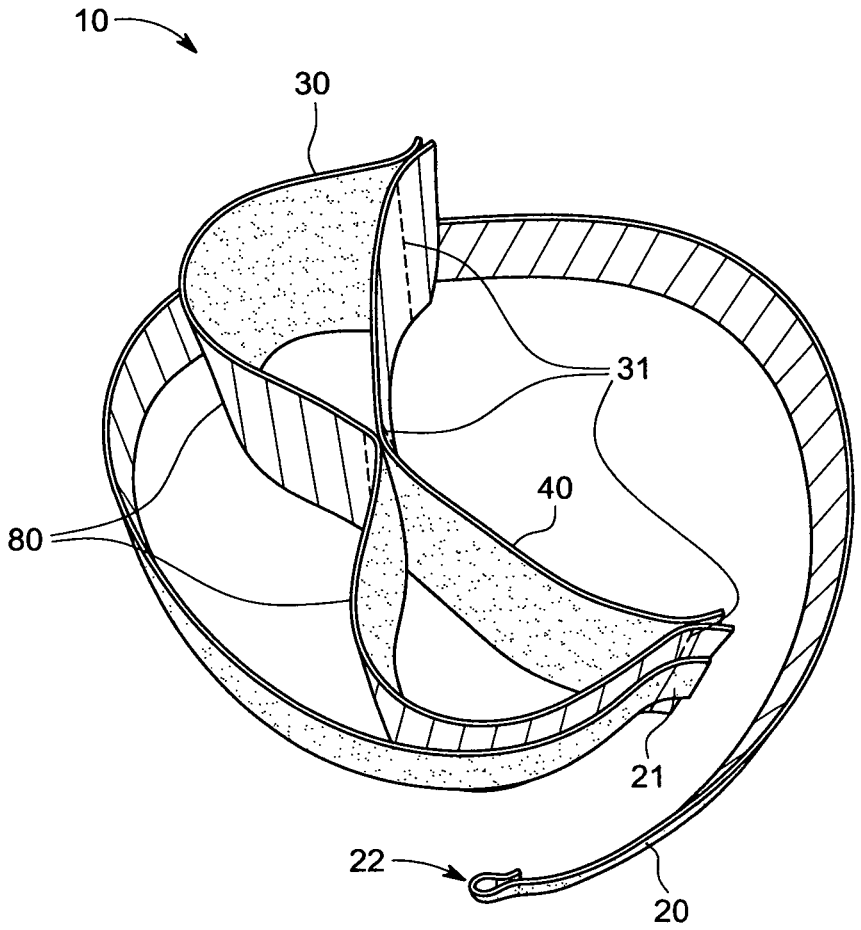
FIG. 9 illustrates an isometric view of a ski tie arranged and configured with the first sheath and the second sheath coupled to the first surface of the base with the ski pole strap undone.

Ski ties 10 can be used to securely bundle skis 70 and ski poles 60 together for easy carrying as illustrated in FIGS. 1, 4, 5, 6, 10 and 11. As illustrated in FIGS. 2, 3 and 9 a ski tie 10 can be made up of ski sleeve 30 and a ski pole strap 20 with the proximal end 21 attached by stitching. The distal end 22 of the ski pole strap 20 is arranged and configured for easy grip for the skier in cold weather with gloves on. A ski sleeve 30 can be made up of a base 40 and two sheaths 80 and all can be coupled together by stitching 31.

Figure 4:
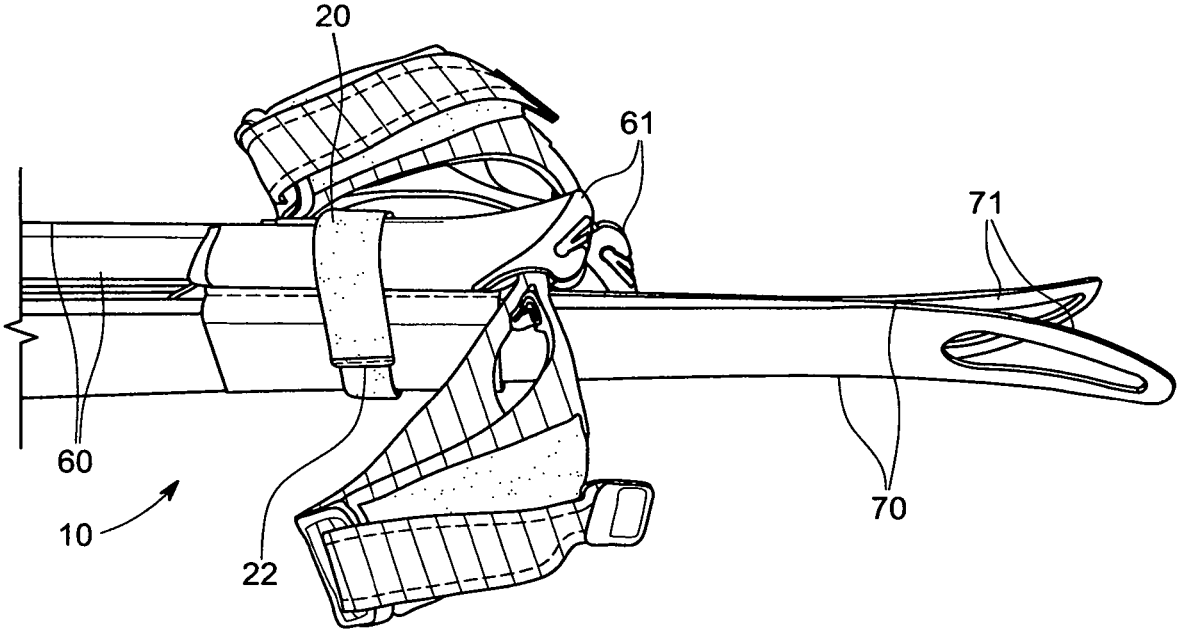
FIG. 4 illustrates an isometric view of a ski tie on the tips of the skis with the ski pole strap secured around the grips of the ski poles. The skis are in a base-to-base position.
Figure 5:
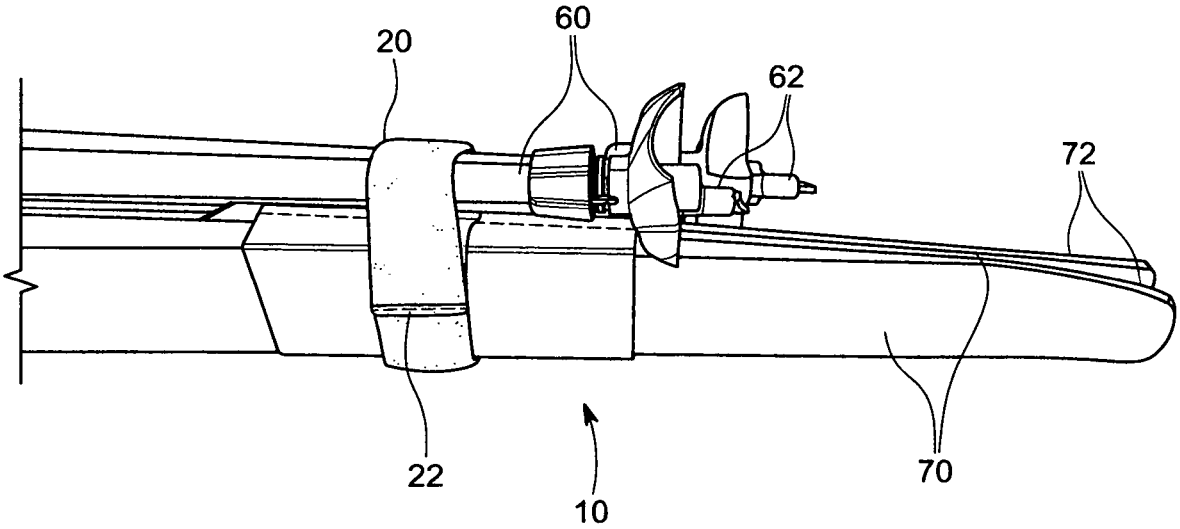
FIG. 5 illustrates an isometric view of a ski tie on the tails of the skis with the ski pole strap secured around the bottom of the ski poles. The skis are in a base-to-base position.
Figure 6:
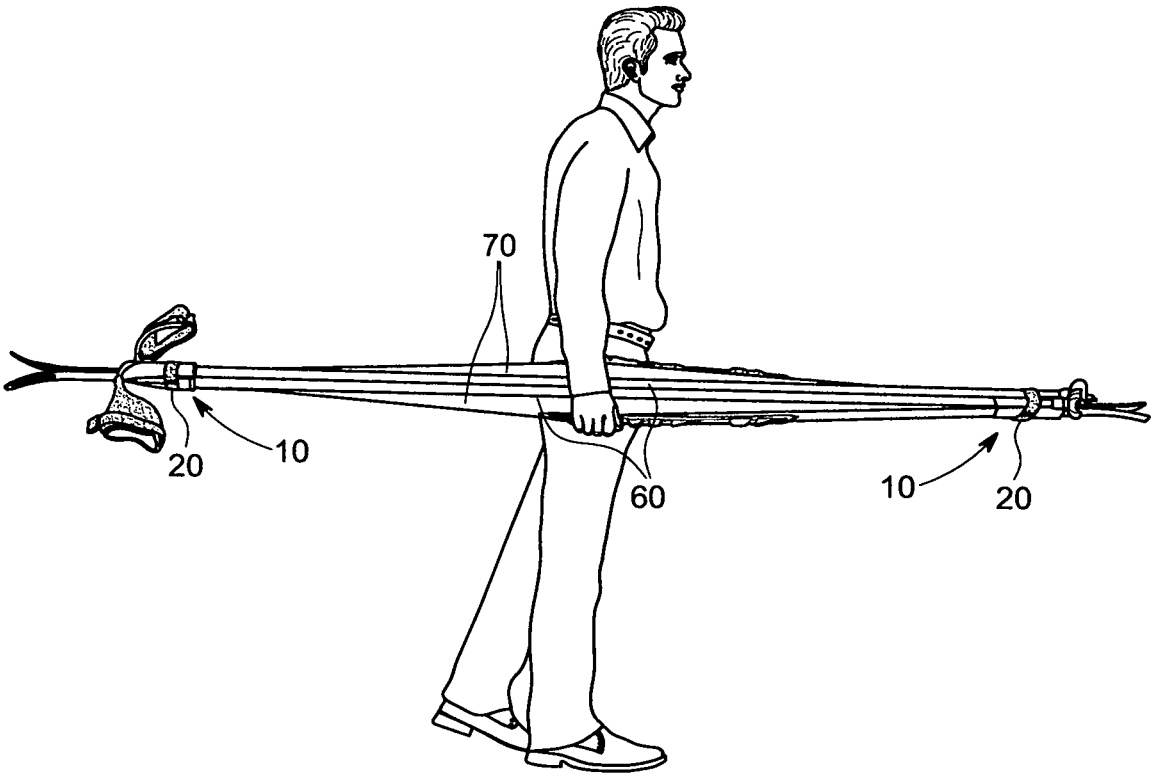
FIG. 6 illustrates an isometric view of the skis and ski poles bundled with the ski ties and being carried without the aid of the lanyard. The skis are in a base-to-base position.

One ski tie 10 is used to bind the ski tips 71 together as illustrated in FIG. 4 and the another ski tie 10 is used to bind the ski tails 72 together illustrated in FIG. 5. The ski pole strap 20 is wrapped around the ski sleeve 30 as illustrated in FIG. 3 when being stored or not being used to secure ski poles 60. The ski pole strap 20 is wrapped around the ski sleeve 30 in addition to the ski poles 60 as illustrated in FIGS. 1, 4, 5, 6, 10 and 11 to secure the ski poles 60 for transportation. The ski pole strap 20 is long enough to wrap around the ski sleeve 30 in addition to the ski pole grips 61 as illustrated in FIGS. 1, 4, 6, 10 and 11. The ski pole strap 20 is long enough to wrap around the ski sleeve 30 in addition to the ski pole tips 62 as illustrated in FIGS. 1, 5, 6, 10 and 11.

Figure 7:
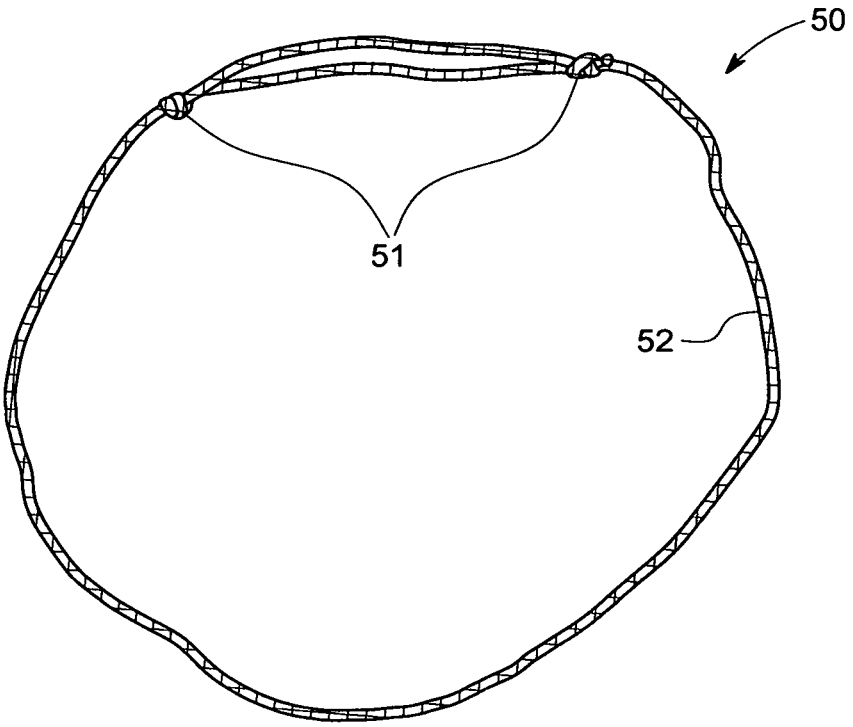
FIG. 7 illustrates a top view of a lanyard partially contracted.

An adjustable closed loop lanyard 50 may comprise a fisherman's knot 51 with a symmetrical structure comprising overhand knots, in their strangle knot form, in each end of the cord 52 around the standing part of the opposite cord 52 as illustrated FIG. 7. The lanyard 50 circumference may be adjusted by sliding the individual knots that make up the fisherman's knot 51 until the desired configuration is attained.

Figure 8:
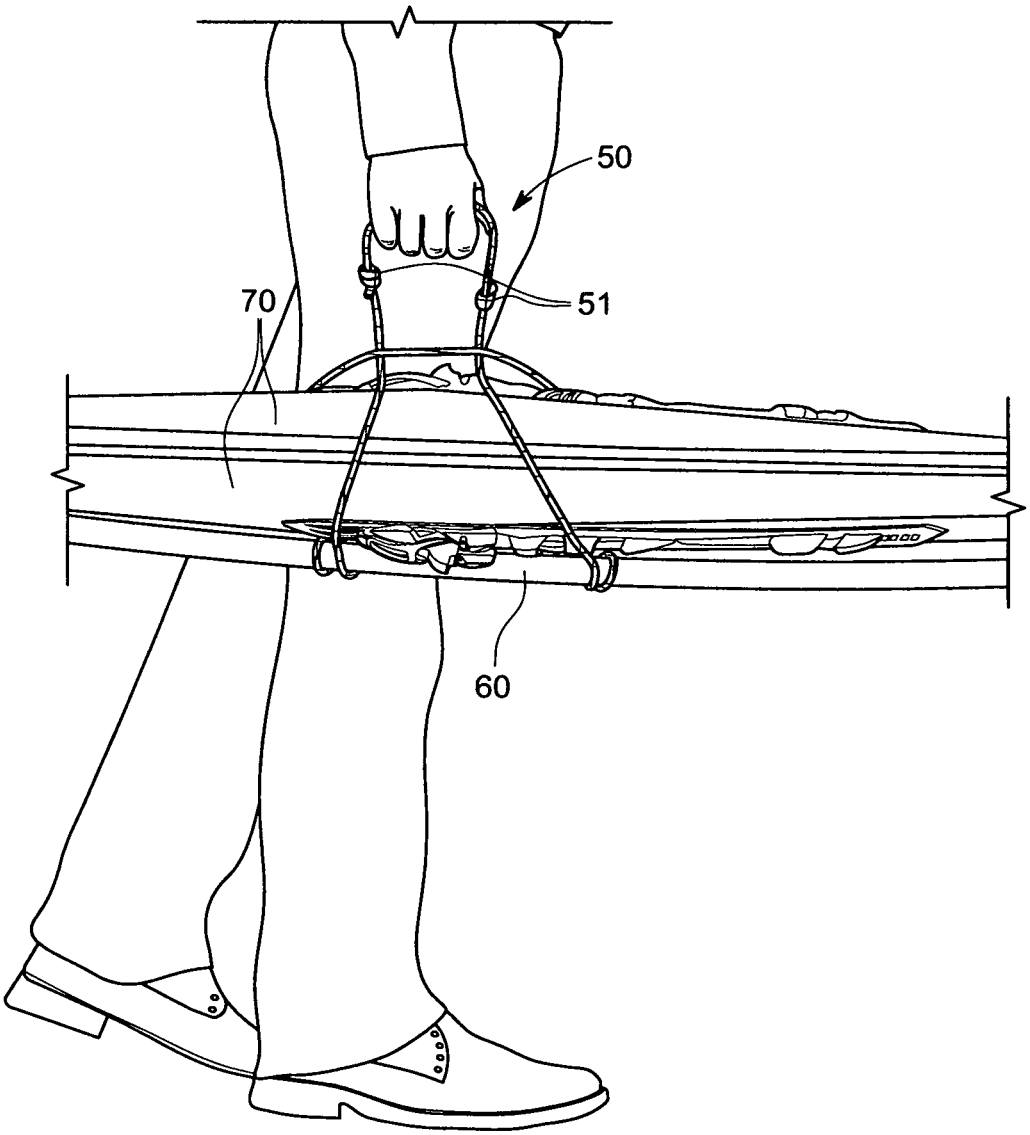
FIG. 8 illustrates an isometric view of the lanyard being used to carry the skis and ski poles with the lanyard being wrapped around the poles on the bottom without the aid of the ski ties. The skis are in a base-to-base position.

A lanyard 50 can be used in combination with the ski ties 10 to aid in the carrying of skis 70 and ski poles 60 as illustrated FIG. 1. A lanyard 50 can also be used independently from the ski ties 10 to bind the skis 70 and ski poles 60 together in an easy to carry bundle as illustrated in FIG. 8 by wrapping the lanyard 50 around the skis 70 and ski poles 60 separately. The adjustability of the lanyard 50 gives the skier the ability to adjust the length for optimal carrying control.

To bundle the skis 70 and ski poles 60 using the ski ties 10, the skis 70 are positioned within the space between the sheath and the base as illustrated in FIGS. 1, 4, 5, 6, 10 and 11. The first ski tie 10 slideably receives a portion of the tip of each of the skis 71 as illustrated in FIG. 4. A second ski tie 10 slideably receives a portion of the tale of each of the skis 72 as illustrated in FIG. 5. Each ski tie 10 is slid towards the center of the skis 70 until the ski tie 10 is tight and securely fastens the skis 70 together as illustrated in FIGS. 1, 6, 10 and 11. The ski pole straps 20 are unfastened to accommodate the ski poles 60 as illustrated in FIGS. 2 and 9. Once the ski poles 60 are placed in parallel with the skis 70 and against the skis 70, the ski pole strap 20 is securely fastened around the ski poles 60 as illustrated in FIGS. 1, 4, 5, 6, 10 and 11 for transportation.

Figure 10:
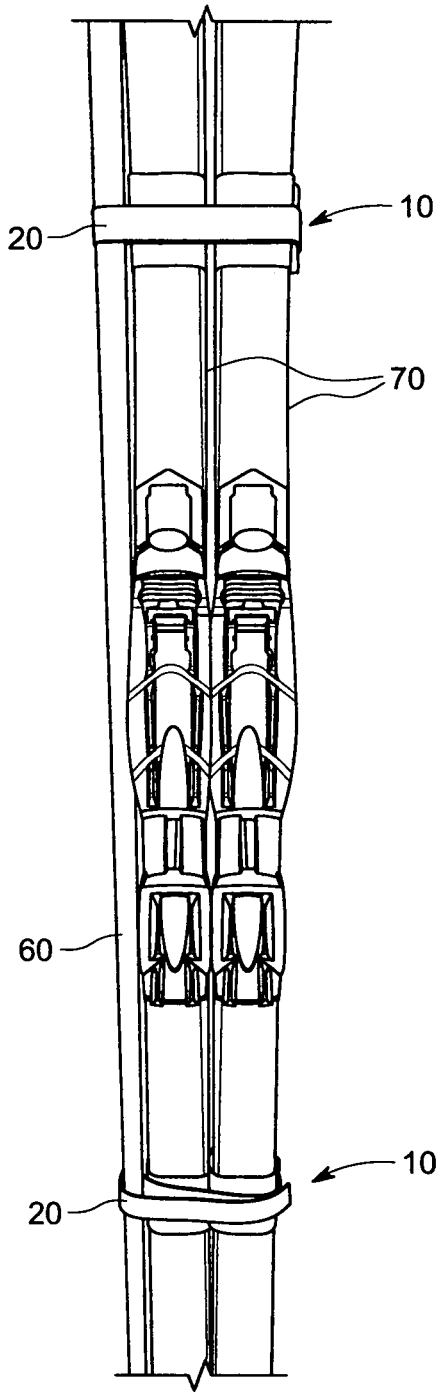
FIG. 10 illustrates an isometric view of the skis and ski poles bundled with the first sheath and the second sheath coupled to a first surface of the base in the first state with the base of the first ski and the base of the second ski facing the same direction. The skis are in a side-by-side position.
Figure 11:
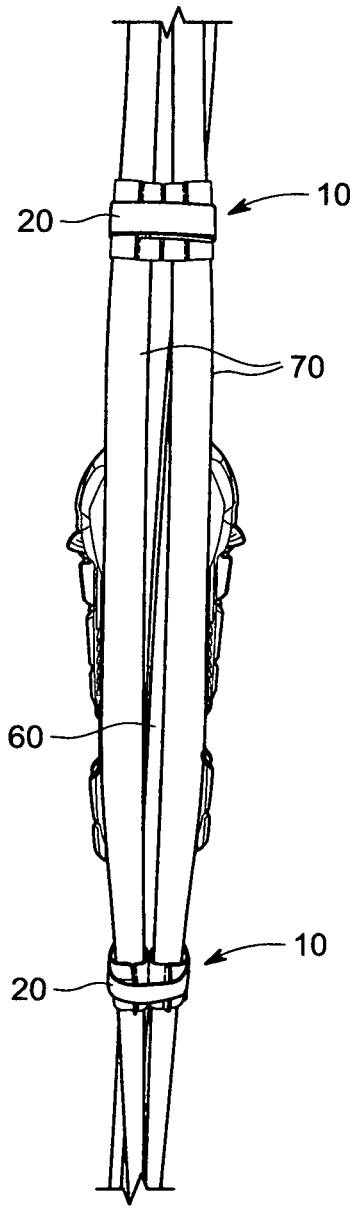
FIG. 11 illustrates an isometric view of the skis and ski poles bundled with the first sheath and the second sheath coupled to a first surface of the base in the second state with the base of the first ski and the base of the second ski facing in opposite directions. The skis are in a base-to-base position.

Ski ties 10 can change from a first state to a second state and back by folding and unfolding each ski tie 10 along the middle stitching 31 as illustrated in FIG. 9. Ski ties 10 can be arranged and configured with both sheaths 80 coupled to the same surface of the same base 40 so they can be arranged and configured in a first state to accommodate skis 70 in a side-by-side position bundled with ski poles 60 using the ski pole strap 20 as illustrated in FIG. 10. Ski ties 10 can also be arranged and configured in a second state to accommodate skis 70 in a base-to-base position bundled with ski poles 60 using the ski pole strap 20 as illustrated in FIG. 11.

Ski ties 10 can be arranged and configured with one sheath 80 coupled to one surface of the base 40 and another sheath 80 coupled to the opposite surface of the base 40 as illustrated in FIGS. 2 and 3.

This disclosure also includes various methods of using the ski ties and lanyard. The method can include placing ski ties on the skis and attaching the ski poles to transport. The method can include detaching the ski poles and removing the ski ties for use of the skis and ski poles.

The method can include attaching the lanyard without the ski ties to transport the skis and ski poles. The method can include removing the lanyard for use of the skis and ski poles. The method can include using the lanyard with the ski ties to transport the skis and ski poles. The method can include removing the lanyard, detaching the ski poles and removing the ski ties for use of the skis and ski poles.

The method can also include manipulating the ski ties between a first state and a second state to place the skis in a side-by-side or base-to-base position.

None of the steps described herein is essential or indispensable. Any of the steps can be adjusted or modified. Other or additional steps can be used. Any portion of any of the steps, processes, structures, and/or devices disclosed or illustrated in one embodiment, flowchart, or example in this specification can be combined or used with or instead of any other portion of any of the steps, processes, structures, and/or devices disclosed or illustrated in a different embodiment, flowchart, or example. The embodiments and examples provided herein are not intended to be discrete and separate from each other.

The section headings and subheadings provided herein are nonlimiting. The section headings and subheadings do not represent or limit the full scope of the embodiments described in the sections to which the headings and subheadings pertain. For example, a section titled "Topic 1" may include embodiments that do not pertain to Topic 1 and embodiments described in other sections may apply to and be combined with embodiments described within the "Topic 1" section.

The various features and processes described above may be used independently of one another, or may be combined in various ways. All possible combinations and subcombinations are intended to fall within the scope of this disclosure. In addition, certain method, event, state, or process blocks may be omitted in some implementations. The methods, steps, and processes described herein are also not limited to any particular sequence, and the blocks, steps, or states relating thereto can be performed in other sequences that are appropriate. For example, described tasks or events may be performed in an order other than the order specifically disclosed. Multiple steps may be combined in a single block or state. The example tasks or events may be performed in serial, in parallel, or in some other manner. Tasks or events may be added to or removed from the disclosed example embodiments. The example systems and components described herein may be configured differently than described. For example, elements may be added to, removed from, or rearranged compared to the disclosed example embodiments.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without author input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations and so forth. Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require at least one of X, at least one of Y, and at least one of Z to each be present.

The term "and/or" means that "and" applies to some embodiments and "or" applies to some embodiments. Thus, A, B, and/or C can be replaced with A, B, and C written in one sentence and A, B, or C written in another sentence. A, B, and/or C means that some embodiments can include A and B, some embodiments can include A and C, some embodiments can include B and C, some embodiments can only include A, some embodiments can include only B, some embodiments can include only C, and some embodiments can include A, B, and C. The term "and/or" is used to avoid unnecessary redundancy.

While certain example embodiments have been described, these embodiments have been presented by way of example only, and are not intended to limit the scope of the inventions disclosed herein. Thus, nothing in the foregoing description is intended to imply that any particular feature, characteristic, step, module, or block is necessary or indispensable. Indeed, the novel methods and systems described herein may be embodied in a variety of other forms; furthermore, various omissions, substitutions, and changes in the form of the methods and systems described herein may be made without departing from the spirit of the inventions disclosed herein.

What is claimed is:

1. A ski and ski pole carrying device, comprising:

a first base configured to receive a first ski and a second ski;

a first sheath and a second sheath coupled to the first base, the first sheath configured to surround at least a portion of the first ski, the second sheath configured to surround at least a portion of the second ski; and a first ski pole strap coupled to at least one of the first base, the first sheath, and the second sheath, the first first ski pole strap configured to wrap around at least a portion of the first sheath and the second sheath and thereby detachably engage a first ski pole and a second ski pole, a second base configured to receive the first ski and the second ski;

a third sheath and a fourth sheath coupled to the second base, the third sheath configured to surround at least a portion of the first ski, the fourth sheath configured to surround at least a portion of the second ski; and a second ski pole strap coupled to at least one of the second base, the third sheath, and the fourth sheath, the second ski pole strap configured to wrap around at least a portion of the third sheath and the fourth sheath and thereby detachably engage the first ski pole and the second ski pole.

2. The ski and ski pole carrying device of claim 1, wherein the first sheath and the second sheath define one continuous first ski tie sheath, and the third sheath and the fourth sheath define one continuous second ski tie sheath.

3. The ski and ski pole carrying device of claim 1, wherein the first ski pole strap is coupled to at least one of the first base, the first sheath, and the second sheath via a proximal end, the first ski pole strap defining a distal end arranged and configured to allow for a user to easily grip the distal end, and the second ski pole strap is coupled to at least one of the second base, the third sheath, and the fourth sheath via a proximal end, the second ski pole strap defining a distal end arranged and configured to allow for a user to easily grip the distal end.

4. The ski and ski pole carrying device of claim 1, wherein the first ski pole strap is arranged and configured to wrap around the first base, the first sheath, and the second sheath whereby a first surface of the first ski pole strap detachably couples to a second surface of the first ski pole strap, and the second ski pole strap is arranged and configured to wrap around the second base, the third sheath, and the fourth sheath whereby a first surface of the second ski pole strap detachably couples to a second surface of the second ski pole strap.

5. The ski and ski pole carrying device of claim 4, wherein the first ski pole strap defines a first hook and loop fastener, and the second ski pole strap defines a second hook and loop fastener.

6. The ski and ski pole carrying device of claim 1, wherein a space between the first base and the first sheath is arranged and configured to slideably receive at least a portion of the first ski, and a space between the first base and the second sheath is arranged and configured to slideably receive at least a portion of the second ski, and a space between the second base and the third sheath is arranged and configured to slideably receive at least a portion of the first ski, and a space between the second base and the fourth sheath is arranged and configured to slideably receive at least a portion of the second ski.

7. The ski and ski pole carrying device of claim 1, further comprising a lanyard defining an adjustable closed loop.

8. The ski and ski pole carrying device of claim 7, wherein the lanyard is adjustable via a fisherman's knot, which is a bend or a knot used to join two cords, using overhand knots in their strangle knot form in each end of the cord around a standing part of an opposite cord.

9. The ski and ski pole carrying device of claim 1, wherein the first base defines a first surface and a second surface facing opposite the first surface, the first base configured to receive the first ski along the first surface and the second ski along the first surface such that a base of the first ski faces a first direction and a base of the second ski faces the first direction.

10. The ski and ski pole carrying device of claim 9, wherein the first base defines a first surface and a second surface facing opposite the first surface, the second base configured to receive the first ski along the first surface and the second ski along the first surface such that a base of the first ski faces a first direction and a base of the second ski faces the first direction.

11. The ski and ski pole carrying device of claim 10, wherein the first sheath and the second sheath are coupled to a first surface of the first base, and the third sheath and the fourth sheath are coupled to a first surface of the second base.

12. The ski and ski pole carrying device of claim 9, wherein the second surface defines a first half and a second half located opposite the first half, wherein the first base is configured to fold along a middle portion such that the first half of the second surface contacts at least a portion of the second half of the second surface.

13. The ski and ski pole carrying device of claim 9, wherein the second surface defines a first half and a second half located opposite the first half, wherein the second base is configured to fold along a middle portion such that the first half of the second surface contacts at least a portion of the second half of the second surface.

14. The ski and ski pole carrying device of claim 13, wherein in the second state the first base receives the first ski and the second ski, and the base of the first ski and the base of the second ski face opposite directions.

15. The ski and ski pole carrying device of claim 9, wherein the first sheath and the second sheath are coupled to a first surface of the first base along a first portion, a second portion located opposite the first portion, and a middle portion located between the first portion and the second portion.

16. The ski and ski pole carrying device of claim 1, wherein the first base is configured to define a first state and a second state, and wherein in the first state the first base receives the first ski and the second ski, and a base of the first ski and a base of the second ski both face a first direction.

17. The ski and ski pole carrying device of claim 1, wherein the first base defines a first surface and a second surface facing opposite the first surface, the first base configured to receive the first ski along the first surface, and receive the second ski along the second surface such that the first ski and the second ski face opposite each other.

18. The ski and ski pole carrying device of claim 1, wherein the first sheath and the second sheath define separate sheaths, and the third sheath and the fourth sheath define separate sheaths.

19. The ski and ski pole carrying device of claim 1, wherein the first sheath is coupled to a first surface of the first base, and the second sheath is coupled to a second surface of the first base, the second surface facing opposite the first surface.

* * * * *